United States Patent [19]

Travis

[11] Patent Number: 4,536,423

[45] Date of Patent: Aug. 20, 1985

[54] WALL ORNAMENT FOR SHOWER AND BATHTUB ENCLOSURES

[76] Inventor: E. Clayton Travis, 4235 Island View Dr., Linden, Mich. 48451

[21] Appl. No.: 641,272

[22] Filed: Aug. 16, 1984

[51] Int. Cl.[3] ..... B44C 5/04

[52] U.S. Cl. ..... 428/14; 40/594; 156/71; 428/40; 428/46; 428/904.4

[58] Field of Search ..... 40/158 B, 158 R, 159, 40/594; 428/13, 14, 913.3, 904.4, 16, 40, 46; D20/31; 156/71

[56] References Cited

U.S. PATENT DOCUMENTS

| | | | |
|---|---|---|---|
| 1,414,656 | 5/1922 | Diaz | 40/158 |
| 1,634,333 | 7/1927 | Mock | 156/71 |
| 2,013,867 | 9/1935 | Sloan | 428/165 |
| 2,142,194 | 1/1939 | Karfiol | 428/904.4 X |
| 2,443,234 | 6/1948 | Ford, Jr. | 40/159 X |
| 3,583,558 | 6/1971 | Davis | 428/906 |
| 3,646,180 | 2/1972 | Winnick | 428/49 X |
| 3,668,805 | 6/1972 | Coleman | 428/16 X |
| 3,879,874 | 4/1975 | Broussard, Sr. | 40/158 R |
| 4,044,405 | 8/1977 | Kreiss | 428/40 X |
| 4,077,830 | 3/1978 | Fulwiler | 428/40 X |
| 4,082,875 | 4/1978 | Citron | 428/14 X |
| 4,093,489 | 6/1978 | Hong | 428/13 X |
| 4,225,369 | 9/1980 | Felchlin | 428/14 X |
| 4,231,833 | 11/1980 | Lieberman | 428/14 X |
| 4,301,199 | 11/1981 | Pfanstiehl | 428/14 |
| 4,324,605 | 4/1982 | Bethea | 428/49 X |
| 4,333,863 | 6/1982 | Lindroth | 428/904.4 X |
| 4,362,591 | 12/1982 | Tracy | 428/47 X |
| 4,384,040 | 5/1983 | Von Meer | 428/323 X |

FOREIGN PATENT DOCUMENTS

| | | | |
|---|---|---|---|
| 2801652 | 7/1979 | Fed. Rep. of Germany | 40/594 |
| 52-43400 | 4/1977 | Japan | 40/594 |

*Primary Examiner*—Henry F. Epstein

*Attorney, Agent, or Firm*—Cullen, Sloman, Cantor, Grauer, Scott & Rutherford

[57] ABSTRACT

A wall ornament for shower and tub enclosures comprises a full scale photograph of a male or female, or other print of interest, which is die cut closely around its periphery and sealed and enclosed within a thin transparent envelope of a plastic material. A plurality of strips of pressure sensitive adhesive are spaced over and secured upon the rear of the envelope for snug and supportive engagement with the wall of a shower or tub enclosure.

2 Claims, 3 Drawing Figures

WALL ORNAMENT FOR SHOWER AND BATHTUB ENCLOSURES

BACKGROUND OF THE INVENTION

Heretofore essentially useful articles and shelves or support rods or other devices are mounted upon the wall of a shower or tub enclosure for holding soap, shampoo, brushes, sponges or hanging towels and washcloths and the like.

SUMMARY OF THE INVENTION

The present invention is directed to an article of manufacture such as a novelty wall ornament or poster adapted for mounting upon the wall of a shower or tub enclosure.

An important feature of the present invention is to provide a wall ornament for a shower or bathtub enclosure which comprises a full scale photograph or print of a female, male or other form such as images of interest to children, which is die cut throughout its periphery and sealed and enclosed within a thin transparent envelope of a plastic material.

A further feature which comprises a full scale photograph of a male or female person which is die cut throughout its periphery and sealed and enclosed within a thin transparent envelope of a plastic material.

A further feature includes a plurality of strips or patches of pressure sensitive adhesive which are spaced over and mounted upon or bonded to the rear of the envelope adapted for snug supportive engagement with the wall of a shower or bathtub enclosure.

A further feature is to provide a novelty article of manufacture namely, a wall ornament or poster for those who do not desire to bath alone, i.e., the perfect shower companion.

These and other features and objects will be seen from the following specification and claims in conjunction with the appended drawing.

THE DRAWING

It will be understood that the above drawing illustrates merely a preferred embodiment of the invention, and that other embodiments are contemplated within the scope of the claims hereafter set forth.

DETAILED DESCRIPTION OF AN EMBODIMENT OF THE INVENTION

Figure 1:
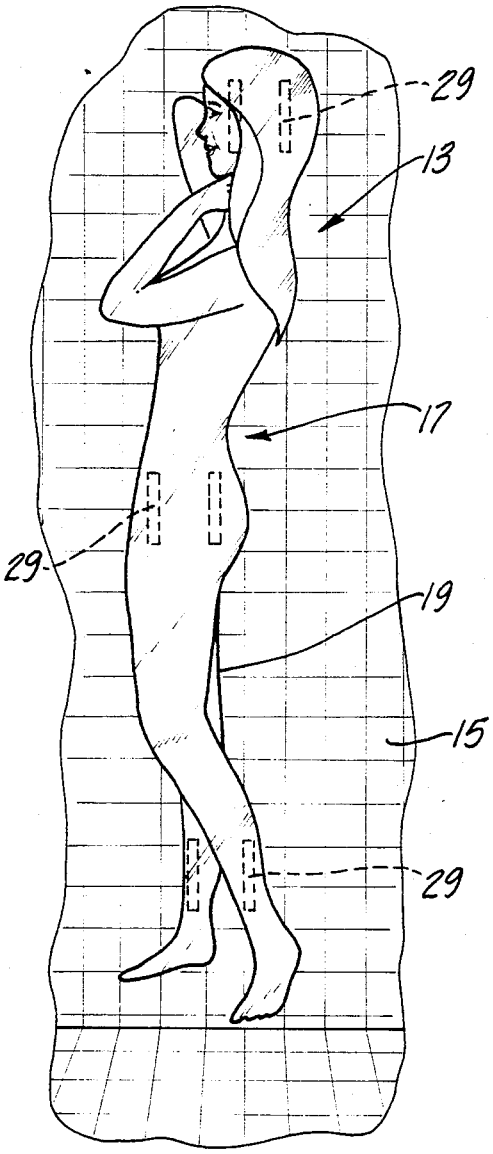
FIG. 1 is a front elevational view of a full scale enclosed ornament as mounted upon the wall of a shower or tub enclosure, with the wall fragmentarily shown.

Referring to the drawing, the present article of manufacture namely, a wall ornament or poster for a shower or tub enclosure is generally indicated at 13, FIG. 1. Said ornament is adapted for mounting and supporting upon the wall 15 of a shower or bathtub enclosure, fragmentarily shown.

The present poster or wall ornament comprises full scale photograph 17 of a human form of a male or female, clothed or unclothed, though not limited thereto. The ornament may be a print of an animal or a comic character of interest to children. The completed full scale photo or print is die cut throughout its periphery defining a peripheral edge 19 surrounding the photo or other image, as to provide a real life appearance as though the image is sharing the shower or tub enclosure with the actual occupant.

The completed die cut photo or other print is enclosed within a thin transparent envelope of a suitable plastic material and sealed therein. In the preferred embodiment, the plastic material employed is a polyethylene plastic of 3 mil thickness, approximately. The envelope may be a transparent vinyl pastic which completely covers the photo or other image.

Figure 2:
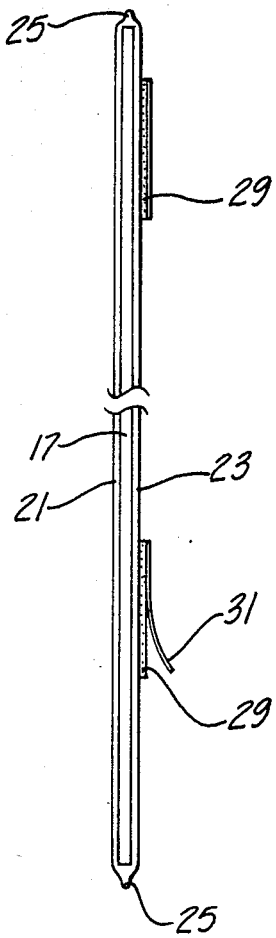
FIG. 2 is a right side elevational view thereof.
Figure 3:
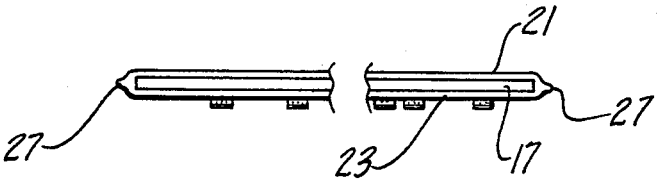
FIG. 3 is a bottom plan view thereof.

Said envelope includes inner laminate 21, FIGS. 2 and 3, outer laminate 23, including top and bottom closures 25 and side closures 27, FIGS. 2 and 3.

A plurality of spaced pressure sensitive adhesive strips 29 are preferably mounted and secured upon and overlie backwall or outer laminate 23 of said envelope. These are adapted for manual pressure and securing engagement with the wall 15 of a shower or tub enclosure, fragmentarily shown in FIG. 1. The pressure sensitive strips 29, normally covered before use with a tear-off paper strip 31, are snugly applied to wall 15 by manual pressure so that the wall ornament is in snug supported surface engagement with wall 15.

Since the present invention is directed to a novelty poster or wall ornament, it is contemplated that the photo or print could be a nude male or female providing the user with a choice of shower or tub companions. For example, the poster may be of a person taking a shower or a tub companion for children. The ornamental waterproof poster may also be used in, hot tub, jacuzzi or sauna, for example.

While any suitable transparent plastic material may be employed to provide the envelope including the laminates 21, 23 and top and bottom edge closures 25 and 27, in a preferred embodiment, a 3 mil polythylene material is employed.

The envelope is so formed as to snugly engage all surface areas of the photo or print 17 conforming to and engaging the die cut edges 19 thereby providing in some cases a simulated real life appearance.

Having described my invention, reference should now be had to the following claims.

I claim:

1. As an article of manufacture, a waterproof ornamental poster for attachment to a vertical wall of a tub or shower enclosure, comprising:

an enlarged photograph of a person or other image;

the contours of said image being die cut generally along its periphery, defining a contoured outer peripheral edge;

an envelope of thin transparent plastic waterproof material enclosing said die cut image, including a first layer overlying the image face and a second layer overlying the image obverse face, and said envelope having a contoured peripheral portion enclosing said die cut image peripheral edge in sealed watertight relation; and a plurality of spaced strips of pressure sensitive adhesive mounted on and overlying said second envelope layer in spaced relation generally along its vertical length for engagement with said vertical tub or shower enclosure wall, retaining said waterproof ornamental poster in snug supported relation along its length.

2. The waterproof ornamental poster defined in claim 1, wherein said first and second envelope layers are heat sealed together in face-to-face relation, outside said image peripheral edge, permanently sealing said image in watertight relation within said envelope.

* * * * *